US006593889B1

(12) United States Patent
Raddant

(10) Patent No.: US 6,593,889 B1
(45) Date of Patent: Jul. 15, 2003

(54) ANTENNA ARRANGEMENT WITH AT LEAST ONE ANTENNA, ESPECIALLY ON THE SCREEN OF A MOTOR VEHICLE

(75) Inventor: Hans-Joachim Raddant, Berlin (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,336

(22) PCT Filed: Nov. 26, 1999

(86) PCT No.: PCT/DE99/03751

§ 371 (c)(1),
(2), (4) Date: Sep. 4, 2001

(87) PCT Pub. No.: WO00/33415

PCT Pub. Date: Jun. 8, 2000

(30) Foreign Application Priority Data

Dec. 3, 1998 (DE) ..... 198 55 825
Aug. 4, 1999 (DE) ..... 199 36 590

(51) Int. Cl.[7] ..... H01Q 1/32
(52) U.S. Cl. ..... 343/713; 343/704
(58) Field of Search ..... 343/704, 713

(56) References Cited

U.S. PATENT DOCUMENTS 4,260,989 A 4/1981 Ishii et al. ..... 343/713
4,422,077 A * 12/1983 Kropielnicki ..... 343/704
4,791,426 A * 12/1988 Lindenmeier et al. ..... 343/713
4,803,492 A * 2/1989 Inaba et al. ..... 219/203
5,548,298 A 8/1996 Nakase ..... 343/713
5,598,170 A * 1/1997 Nakase ..... 343/704
5,790,079 A * 8/1998 Zafar ..... 343/704
6,130,645 A * 10/2000 Lindenmeier et al. ..... 343/704
6,215,450 B1 * 4/2001 Oka ..... 343/704
6,229,493 B1 * 5/2001 Iijima ..... 343/704
6,243,043 B1 * 6/2001 Terashima et al. ..... 343/704

FOREIGN PATENT DOCUMENTS

EP 0 155 647 9/1985
EP 0 847 100 6/1998

* cited by examiner

*Primary Examiner*—Tan Ho
(74) *Attorney, Agent, or Firm*—Kenyon & Kenyon

(57) ABSTRACT

An antenna system is described having at least one LMK antenna which is arranged on a window or another non-conducting part of a motor vehicle and has an antenna capacitance $C_a$, and an antenna booster for the LMK reception. The antenna is characterized in that the distance of the antenna conductor(s) to the parts surrounding the LMK antenna is selected in such a way that the value of the harmful capacitance $C_a$ of the LMK antenna, which is essentially formed by the capacitance between the antenna conductors and the conductive parts surrounding the antenna, is selected to be greater than the value at which the maximum antenna output voltage results, and the value of the harmful capacitance $C_a$ is selected such that, by increasing the source capacitance of the antenna booster, the signal-to-noise ratio is optimized in the lower LMK range.

13 Claims, 2 Drawing Sheets

ANTENNA ARRANGEMENT WITH AT LEAST ONE ANTENNA, ESPECIALLY ON THE SCREEN OF A MOTOR VEHICLE

FIELD OF THE INVENTION

The present invent ion relates to an antenna system having at least one LMK (Long-Medium-Short) radio aerial antenna which is arranged on a window or another non-conducting part of a motor vehicle and has an antenna capacitance $C_a$, and having an antenna booster for the LMK reception.

Such antenna systems are used in particular on the rear window of a motor vehicle. However, they can of course be used on other windows such as side windows, the windshield or other non-conducting parts of motor vehicles such as spoilers.

BACKGROUND INFORMATION

An antenna system is described in European Published Patent Application No. 0 155 647. This known antenna system, which obviously is conceived exclusively for use on the rear window of motor vehicles, is arranged on an area not covered by the heating field. The LMK antenna has a planar extension.

It can be inferred from the teaching of European Published Patent Application No. 0 155 647 that the size of the antenna area must be in a specific relationship to the size of the available area, in order to receive a maximum input signal for the antenna booster. It is specifically explained that, in order for the reception to become optimum, it is also absolutely necessary that the signal voltage be maximum at the input of the LMK booster.

In this context, it is apparently assumed that the noise voltage at the input terminal of the LMK booster is independent of the source impedance.

However, in practice it has turned out that when using an antenna system according to European Published Patent Application No. 0 155 647, the reception is not optimal under certain conditions.

SUMMARY OF THE INVENTION

According to the present invention, it has been recognized that this is attributable to the fact that a maximization of the signal voltage at the input terminal of the antenna booster does not deliver an optimal result under all operating conditions, since the assumption, apparently made in European Published Patent Application No. 0 155 647, about the independence of the noise voltage from the source impedance is incorrect. Namely, the noise voltage of an FET (field-effect transistor) customarily used as input transistor in the LMK booster actually increases perceptibly, at least in the long-wave range and in the "low" medium-wave range, when a conductive surface acting as antenna is used as the signal source.

The reason for this is that the conductive surface acts as a capacitor whose impedance increases as the frequency falls. All transistors exhibit minimal noise only in response to a quite specific source impedance. Their noise increases in the case of impedance deviating therefrom. Specifically, this means that although the antenna known from European Published Patent Application No. 0 155 647 may be optimally matched in the upper medium-wave range and in the short-wave range (also known as the upper LMK range), losses in the reception quality are accepted in the lower medium-wave range and in the long-wave range (lower LMK range). This is also of particular disadvantage since the signal-to-noise ratio of the antenna is markedly poorer anyway in the lower LMK range and, above all, in the long-wave range, than in the upper LMK range.

An object of the present invention is to further develop an antenna system in such a way that optimum reception is yielded under virtually all operating conditions and frequencies.

In this context, the present invention starts out from the root idea of carrying out the matching between the LMK antenna and the antenna booster in such a way that an optimal signal-to-noise ratio results in the lower LMK range.

To that end, according to the present invention, the distance of the antenna conductor(s) to the parts surrounding the LMK antenna is selected in such a way that the value of the harmful capacitance $C_a$ of the LMK antenna, which is essentially formed by the capacitance between the antenna conductors and the conductive parts surrounding the antenna, is selected to be greater than the value at which the maximum antenna output voltage results, and that the value of the harmful capacitance $C_a$ is selected such that, by appropriate selection of the source impedance of the antenna booster, the signal-to-noise ratio is optimized not in the upper, but rather in the lower LMK range.

Thus, the present invention breaks with the usual procedure, according to which harmful or stray capacitance is minimized to the greatest extent possible. On the contrary, according to the present invention, a comparatively large harmful capacitance is deliberately "adjusted", by which the source capacitance of the input transistor is increased in such a way that, although the input signal is not maximal, the signal-to-noise ratio is probably optimal.

This matching according to the present invention can be achieved, for example, by selecting conductive area A acting as antenna to be larger than is described in European Published Patent Application No. 0 155 647. Since according to the present invention, area A is enlarged compared to the related art, the capacitance of the antenna increases specific to the electromagnetic field.

At the same time, the harmful capacitance increases because of the reduced distance to the conductive parts such as metallic body parts, the heating wires of the rear window, etc. surrounding the antenna conductors. Therefore, given the same frequency f of the electromagnetic signal, the amount of the capacitive portion $Z_k$ of the source impedance is smaller. Consequently, the amount Z of the source impedance decreases.

It may be that the signal voltage at the booster input also decreases, however, the input noise of the transistor utilized is also very markedly reduced in the lower LMK range at the same time. In the long-wave range (with small signal frequency f) and in the lower medium-wave range, this measure leads to an improvement in the signal-to-noise ratio for virtually all common transistors.

DETAILED DESCRIPTION

Figure 1:
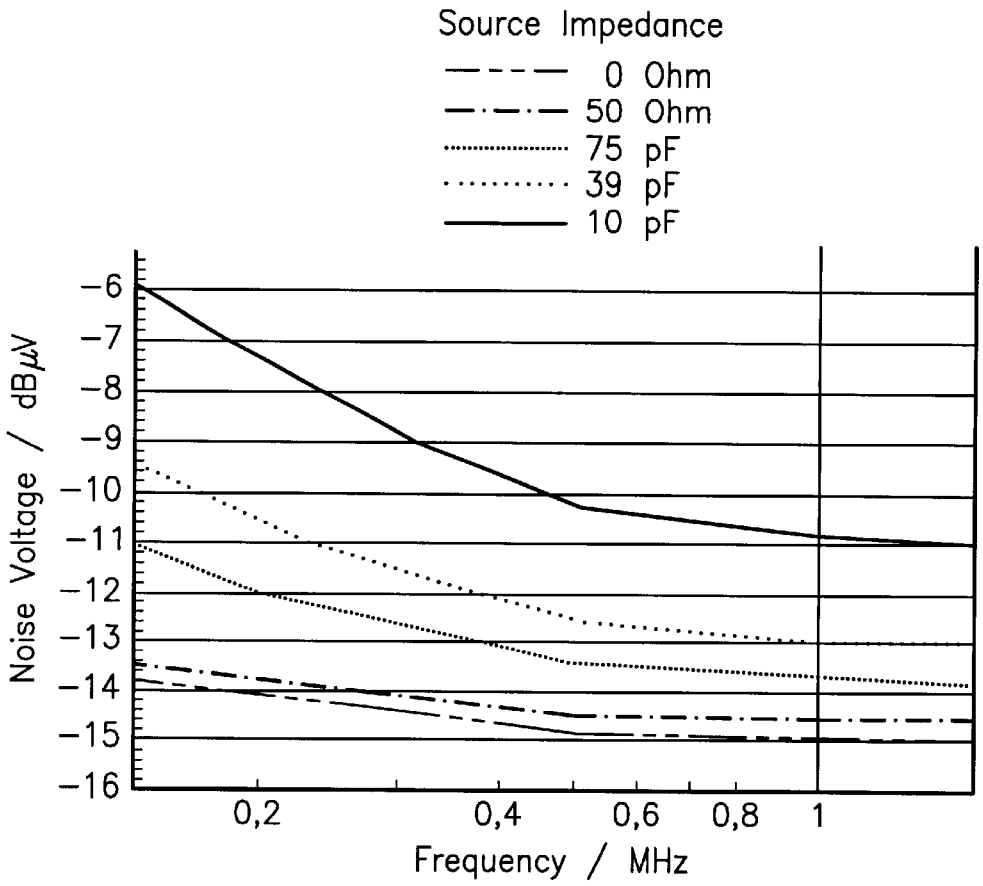
FIG. 1 shows the noise voltage of a customary LMK booster having an FET J310 as the boosting element.

FIG. 1 shows the noise voltage of a customary LMK booster, having an FET J310 as boosting element, as functions of the frequency in the long-wave and medium-wave range. The frequency in MHz is plotted on the abscissa, while the noise voltage is indicated on the ordinate. FIG. 1 indicates the dependence of the noise voltage as a function of the frequency for different source impedances. Reference is made to the legend in FIG. 1 for the values of the source impedances. It can be gathered from FIG. 1 that, with diminishing source impedance, the noise voltage for the transistor presented by way of example increases sharply, at least for frequencies under 1 MHz.

Figure 2:
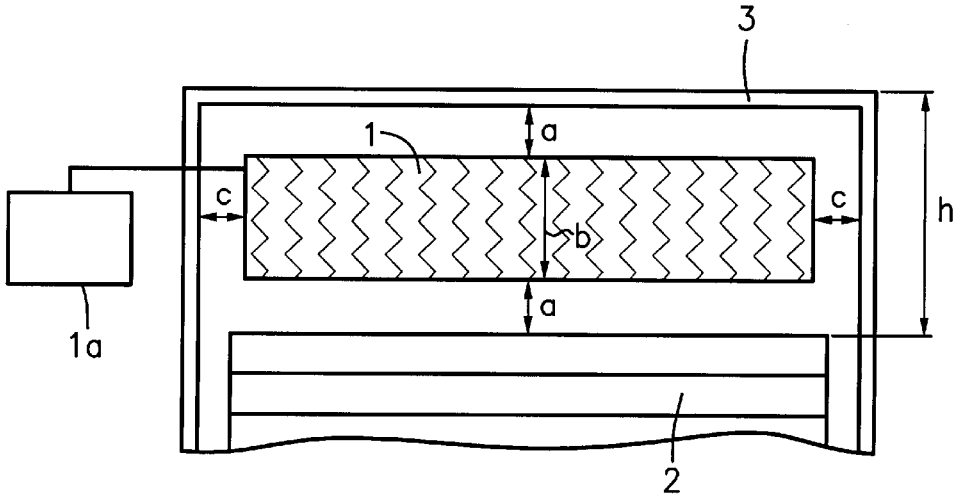
FIG. 2 shows schematically a rear-window antenna.

FIG. 2 shows by way of example the arrangement of an LMK antenna 1 of the present invention on the rear window of a motor and an antenna booster for an LMK reception 1*a*. In this case, LMK antenna 1 is disposed between a heating field 2 and a conductive, frame 3 of the rear window. Centered in this area is the antenna as a conductive area. The antenna has transverse measurement b and distance a from frame 3 and heating field 2, respectively. c is the distance of the antenna from the lateral boundary of the window. In one embodiment, antenna booster 1*a* includes an input transistor corresponding to an FET J-Transistor.

The distance between the topmost conductor of heating field 2 and frame 3 of the window is designated by h.

In the exemplary embodiment presented in greater detail below, without restriction of the generality of the present invention:

$h$=13 cm

To optimize the signal-to-noise ratio, lateral distance c of the antenna to the conductive window frame has been retained constantly at 3 cm. Only transverse measurement b is varied. However, it is of course also possible to vary both c and b.

Figure 3:
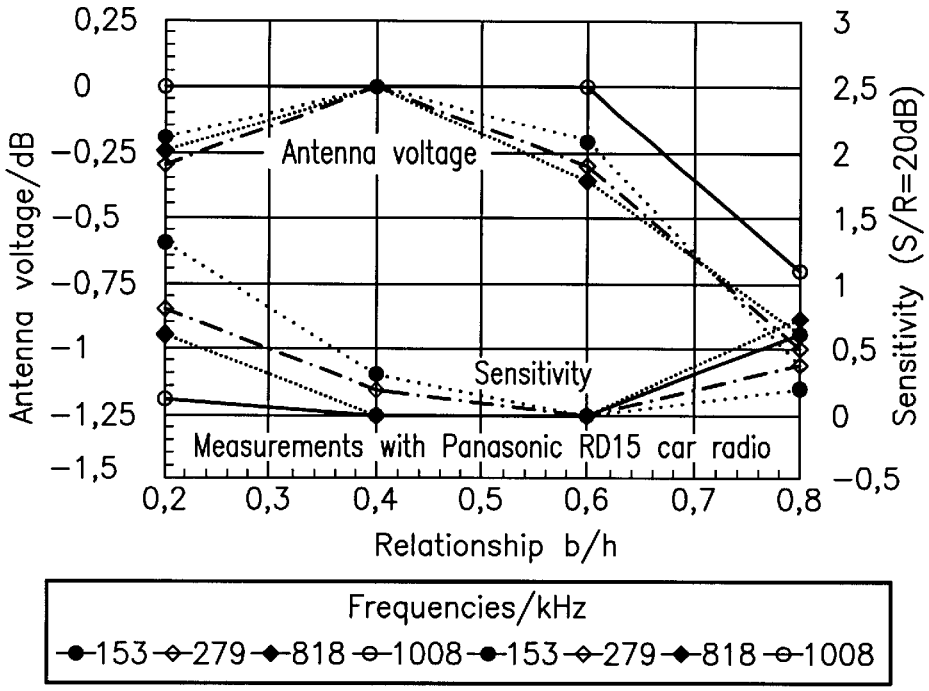
FIG. 3 shows measurements for clarifying the present invention.

FIG. 3 shows the measuring results obtained with a car radio selected as an example. The relationship b/h is plotted on the abscissa, while the antenna voltage is plotted on the left ordinate and the sensitivity for a signal-to-noise ratio of 20 dB is plotted on the right ordinate.

The values for various frequencies are specified, the allocation of the utilized symbols to specific frequency values being indicated in the legend below the diagram.

FIG. 3 shows that a maximum antenna voltage is indeed obtained at a value of the relationship b/h of 0.4, however an optimal signal-to-noise ratio is not obtained, at least for frequencies in the lower LMK range.

On the other hand, if—as is proposed according to the present invention by way of example for the value h=13 cm—a value of the relationship b/h of 0.6 is selected, then a lower antenna voltage is obtained in the entire frequency range, which means non-linear distortions are reduced to the same degree. At the same time, the signal-to-noise ratio improves in the lower LMK range, while it is only insignificantly reduced in the upper LMK range.

Figure 4:
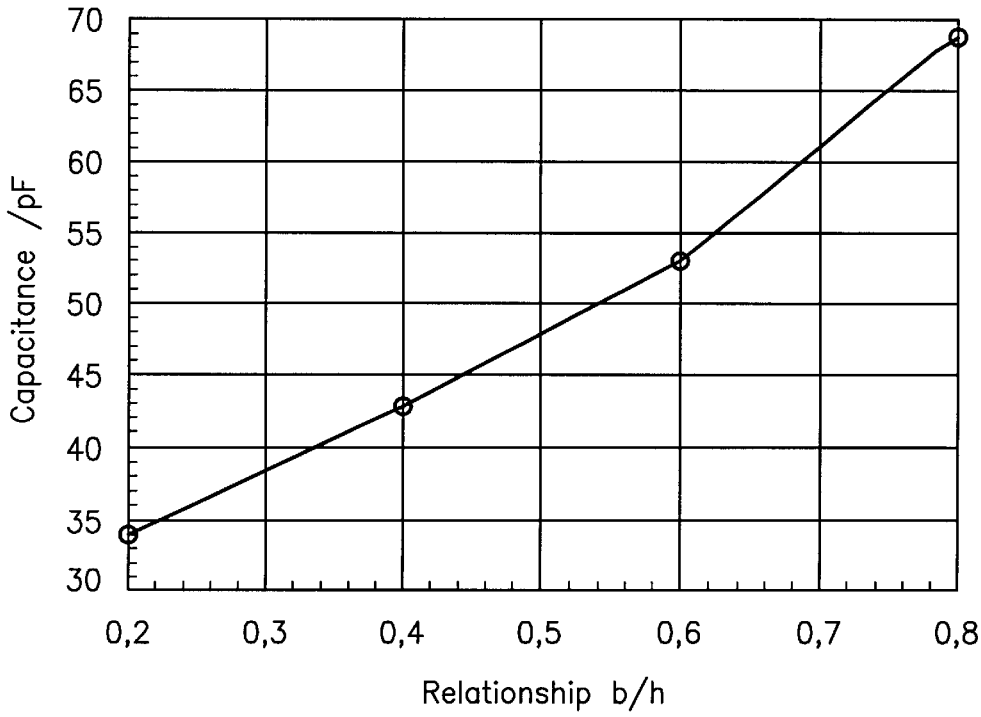
FIG. 4 shows the dependence of the antenna capacitance on the relationship b/h.

FIG. 4 shows the capacitance of the antenna in pF as a function of the relationship b/h. As FIG. 4 shows, the capacitance rises in a largely linear manner up to a value b/h=0.6. Above this value, the harmful capacitance $C_a$ rises disproportionately given the considered height h of the AM antenna, which means not only the antenna voltage, but also the signal-to-noise ratio diminishes.

The present invention has been described above by way of example without restricting the general inventive idea. Thus, widely differing changes are possible compared to the exemplary embodiment shown. A few of these are indicated—not conclusively—in the following:

In particular, the value 0.6 for an optimal b/h relationship according to the teaching of the present invention is valid only for a height h of the available area of 13 cm. When working with other heights h, the optimal b/h relationship is at different values; these values can be found on the basis of the above explanations without inventive assistance, in that the signal-to-noise ratio is optimized in the lower LMK range. This always leads to a greater b/h relationship than the optimization of the signal-to-noise ratio for the upper LMK range or the maximization of the signal magnitude for the upper LMK range.

Furthermore, it is possible to apply the antenna on any windows—not only the rear window—or on other non-conductive parts of the vehicle such as spoilers, built-on parts made of a plastic material, etc. In the arrangement of the antenna on the rear window, it is also possible to integrate into the entire antenna system a VHF antenna, which uses the heating wires of the heatable rear window. The LMK antenna of the present invention can, of course, also have a form different from that shown, for example, a non-rectangular form or the shape of a U or an E.

In addition, it is possible to provide antennas of the present invention in the rear window both above and below the region used for the heating wires.

What is claimed is:

1. An antenna system, comprising:

at least one LMK antenna having an antenna capacitance and arranged on one of a window and another non-conductive part of a motor vehicle, the at least one LMK antenna including at least one antenna conductor; and an antenna booster for an LMK reception, wherein:

an antenna output voltage passes through a maximum as a function of a relative width of the at least one LMK antenna, the antenna capacitance increases in accordance with an increase of the relative width of the at least one LMK antenna, a distance of the at least one antenna conductor to parts surrounding the at least one LMK antenna is selected such that a value of the antenna capacitance of the at least one LMK antenna is selected to be greater than a value at which the maximum of the antenna output voltage results, and the value of the antenna capacitance is selected such that, resulting at an input of the antenna booster is a capacitance at which a signal-to-noise ratio of the antenna booster is greater in a lower LMK range than if the maximum of the antenna output voltage is present.

2. The antenna system according to claim 1, wherein:

the antenna booster includes an input transistor corresponding to an FET J-transistor.

3. The antenna system according to claim 1, wherein:

the at least one antenna conductor is rectangular and planar.

4. The antenna system according to claim 3, wherein:

the at least one antenna is formed as one of a broad strip and a grid.

5. The antenna system according to claim 1, wherein:

the at least one conductor includes a plurality of conductors that are parallel to one another and are arranged as a wire structure that forms the at least one LMK antenna, and a connection point is arranged on a narrow side of the wire structure.

6. The antenna system according to claim 5, wherein:

the plurality of conductors are interconnected in a non-electroconductive manner on a side opposite the connection point.

7. The antenna system according to claim 5, wherein:

the plurality of conductors are imprinted on the window.

8. The antenna system according to claim 1, wherein:

the at least one LMK antenna is not connected directly to a heating field arranged in the window.

9. The antenna system according to claim 8, wherein:

the heating field is used for a VHF reception.

10. The antenna system according to claim 1, wherein:

the value of the antenna capacitance is as a function of the relative width of the at least one LMK antenna, and a height of a predefined free surface area for the at least one LMK antenna is derived from a sum of a distance of the at least one antenna conductor from an upper boundary of the window, a distance of the at least one antenna conductor from one of a heating field and a lower boundary of the window, and a transverse measurement of the at least one antenna conductor.

11. The antenna system according to claim 10, wherein:

a value of the relative width of the at least one LMK antenna differs by at least ±20% from a value at which a maximum signal voltage is present at the input of the antenna booster.

12. The antenna system according to claim 1, wherein:

a distance of the at least one antenna conductor from an upper boundary of the window is substantially equal to a distance of the at least one antenna conductor from a heating field.

13. The antenna system according to claim 1, wherein:

distances of the at least one antenna conductor from a lateral boundary of the window are substantially equal.

* * * * *

UNITED STATES PATENT AND TRADEMARK OFFICE

CERTIFICATE OF CORRECTION

PATENT NO. : 6,593,889 B1
APPLICATION NO. : 09/857336
DATED : July 15, 2003
INVENTOR(S) : Hans-Joachim Raddant It is certified that error appears in the above-identified patent and that said Letters Patent is hereby corrected as shown below:

On the Title Page of the patent, # (73), please change assignee "Robert Bosch GmbH", to --Blaupunkt Antenna Systems GmbH & Co. KG--.

Signed and Sealed this
Thirteenth Day of March, 2012

David J. Kappos

David J. Kappos
*Director of the United States Patent and Trademark Office*